US010496027B1

(12) United States Patent
Carpenter et al.

(10) Patent No.: US 10,496,027 B1
(45) Date of Patent: Dec. 3, 2019

(54) REPLACEABLE UNIT FOR AN ELECTROPHOTOGRAPHIC IMAGE FORMING DEVICE HAVING A RETRACTABLE ELECTRICAL CONNECTOR

(71) Applicant: LEXMARK INTERNATIONAL, INC., Lexington, KY (US)

(72) Inventors: Brian Scott Carpenter, Lexington, KY (US); Kyle Bradley Martin, Lexington, KY (US); Randal Scott Williamson, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 16/547,700

(22) Filed: Aug. 22, 2019

Related U.S. Application Data

(63) Continuation of application No. 16/227,171, filed on Dec. 20, 2018, which is a continuation of application No. 15/948,252, filed on Apr. 9, 2018, now Pat. No. 10,197,964, which is a continuation of application No. 15/655,943, filed on Jul. 21, 2017, now Pat. No.
(Continued)

(51) Int. Cl.

| | |
|---|---|
| ***G03G 15/08*** | (2006.01) |
| ***G03G 21/16*** | (2006.01) |
| ***G03G 21/18*** | (2006.01) |
| ***G03G 15/00*** | (2006.01) |
| ***H01R 13/629*** | (2006.01) |

(52) U.S. Cl.
CPC ..... *G03G 15/80* (2013.01); *G03G 15/0865* (2013.01); *G03G 15/0875* (2013.01); *G03G 21/1652* (2013.01); *G03G 21/1817* (2013.01); *G03G 21/1867* (2013.01); *G03G 15/0891* (2013.01); *G03G 21/1821* (2013.01); *G03G 2215/085* (2013.01); *H01R 13/629* (2013.01)

(58) Field of Classification Search
CPC ..... G03G 15/0865; G03G 15/0875; G03G 15/0891; G03G 15/80; G03G 21/1652; G03G 21/1817; G03G 21/1867; G03G 21/1821; G03G 2215/085; H01R 13/629
See application file for complete search history.

(56) References Cited

U.S. PATENT DOCUMENTS 8,938,179 B2 * 1/2015 Amann ..... G03G 15/0865 399/111
8,948,650 B2 * 2/2015 Newman ..... G03G 15/0886 399/106

* cited by examiner

*Primary Examiner* — Sophia S Chen
(74) *Attorney, Agent, or Firm* — Justin M. Tromp

(57) ABSTRACT

A replaceable unit for an electrophotographic image forming device according to one example includes a housing having a toner reservoir. An electrical connector mounted on the housing is movable between a retracted position and an operative position. The electrical connector includes an electrical contact for contacting a corresponding electrical contact in the image forming device. The electrical contact is electrically connected to processing circuitry on the housing. In the retracted position, the electrical connector is tucked into a portion of the housing. In the operative position, the electrical connector is exposed to permit the electrical contact to contact the corresponding electrical contact in the image forming device. A linkage is operatively connected to the electrical connector and includes an engagement surface accessible on an exterior of the housing to receive an actuation force. Movement of the linkage moves the electrical connector between the retracted position and the operative position.

34 Claims, 11 Drawing Sheets

Related U.S. Application Data

9,971,295, which is a continuation of application No. 15/386,034, filed on Dec. 21, 2016, now Pat. No. 9,746,815, which is a continuation of application No. 14/967,552, filed on Dec. 14, 2015, now Pat. No. 9,563,169.

REPLACEABLE UNIT FOR AN ELECTROPHOTOGRAPHIC IMAGE FORMING DEVICE HAVING A RETRACTABLE ELECTRICAL CONNECTOR

CROSS REFERENCES TO RELATED APPLICATIONS

This patent application is a continuation application of U.S. patent application Ser. No. 16/227,171, filed Dec. 20, 2018, entitled "Replaceable Unit for an Electrophotographic Image Forming Device Having a Retractable Electrical Connector," which is a continuation application of U.S. patent application Ser. No. 15/948,252, filed Apr. 9, 2018, now U.S. Pat. No. 10,197,964, issued Feb. 5, 2019, entitled "Replaceable Unit for an Electrophotographic Image Forming Device Having a Retractable Electrical Connector," which is a continuation application of U.S. patent application Ser. No. 15/655,943, filed Jul. 21, 2017, now U.S. Pat. No. 9,971,295, issued May 15, 2018, entitled "Electrophotographic Image Forming Device Having a Replaceable Unit that Includes a Retractable Electrical Connector," which is a continuation application of U.S. patent application Ser. No. 15/386,034, filed Dec. 21, 2016, now U.S. Pat. No. 9,746,815, issued Aug. 29, 2017, entitled "Replaceable Unit for an Electrophotographic Image Forming Device Having a Retractable Electrical Connector," which is a continuation application of U.S. patent application Ser. No. 14/967,552, filed Dec. 14, 2015, now U.S. Pat. No. 9,563,169, issued Feb. 7, 2017, entitled "Replaceable Unit for an Electrophotographic Image Forming Device Having a Retractable Electrical Connector."

BACKGROUND

1. Field of the Disclosure

The present disclosure relates generally to image forming devices and more particularly to a replaceable unit for an electrophotographic image forming device having a retractable electrical connector.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

The image forming device's toner supply is typically stored in one or more replaceable units that have a shorter lifespan than the image forming device. It is desired to communicate various operating parameters and usage information of the replaceable unit(s) to the image forming device for proper operation. For example, it may be desired to communicate such information as replaceable unit serial number, replaceable unit type, toner color, toner capacity, amount of toner remaining, license information, etc. The replaceable unit(s) typically include processing circuitry configured to communicate with and respond to commands from a controller in the image forming device. The replaceable unit(s) also include memory associated with the processing circuitry that stores program instructions and information related to the replaceable unit. The processing circuitry and associated memory are typically mounted on a circuit board that is attached to the replaceable unit. The replaceable unit also includes one or more electrical contacts that mate with corresponding electrical contacts in the image forming device upon installation of the replaceable unit in the image forming device in order to facilitate communication between the processing circuitry of the replaceable unit and the controller of the image forming device. It is important to accurately position the electrical contacts of the replaceable unit relative to the corresponding electrical contacts of the image forming device in order to ensure a reliable connection between the processing circuitry of the replaceable unit and the controller of the image forming device when the replaceable unit is installed in the image forming device.

Accordingly, positioning features that provide precise alignment of the electrical contacts of the replaceable unit with corresponding electrical contacts of the image forming device are desired. It is also desired to protect the electrical contacts of the replaceable unit and the electrical contacts of the image forming device from damage during insertion and removal of the replaceable unit into and out of the image forming device and during service of the image forming device.

SUMMARY

A replaceable unit for use in an electrophotographic image forming device according to one example embodiment includes a housing having a top, a bottom, a front and a rear positioned between a first side and a second side of the housing. The housing has a reservoir for holding toner. An electrical connector is mounted on the housing. The electrical connector is movable between a retracted position and an operative position. The electrical connector includes an electrical contact for contacting a corresponding electrical contact in the image forming device. The electrical contact is electrically connected to processing circuitry mounted on the housing. The electrical connector is tucked into a portion of the housing when the electrical connector is in the retracted position. The electrical connector is exposed to permit the electrical contact to contact the corresponding electrical contact in the image forming device when the electrical connector is in the operative position. A linkage is operatively connected to the electrical connector. The linkage includes an engagement surface that is accessible on an exterior of the housing to receive an actuation force. Movement of the linkage moves the electrical connector between the retracted position and the operative position. In some embodiments, the electrical connector protrudes from the housing to permit the electrical contact to contact the corresponding electrical contact in the image forming device when the electrical connector is in the operative position.

In some embodiments, the electrical connector is biased by a biasing member toward the retracted position.

Embodiments include those wherein the electrical connector moves upward toward the top of the housing when the electrical connector moves from the retracted position to the operative position and the electrical connector moves downward toward the bottom of the housing when the electrical connector moves from the operative position to the retracted position.

In some embodiments, the linkage is positioned on the first side of the housing and the engagement surface is accessible at the rear of the housing to receive the actuation force at the rear of the housing. The electrical connector is operatively connected to the linkage such that the electrical connector moves from the retracted position toward the operative position when the engagement surface receives the actuation force in a direction toward the front of the housing.

A toner cartridge for use in an electrophotographic image forming device according to one example embodiment includes a housing having a top, a bottom, a front and a rear positioned between a first side and a second side of the housing. The housing has a reservoir for holding toner. An outlet port is in fluid communication with the reservoir and faces downward on the front of the housing for exiting toner from the toner cartridge. An electrical connector is positioned on the first side of the housing. The electrical connector is movable between a retracted position and an operative position. The electrical connector moves upward toward the top of the housing when the electrical connector moves from the retracted position to the operative position. The electrical connector moves downward toward the bottom of the housing when the electrical connector moves from the operative position to the retracted position. The electrical connector includes an electrical contact for contacting a corresponding electrical contact in the image forming device. The electrical contact is electrically connected to processing circuitry mounted on the housing. A linkage is operatively connected to the electrical connector such that movement of the linkage moves the electrical connector between the retracted position and the operative position.

In some embodiments, the electrical connector is biased by a biasing member toward the retracted position.

Embodiments include those wherein the electrical connector translates upward toward the top of the housing when the electrical connector moves from the retracted position to the operative position and the electrical connector translates downward toward the bottom of the housing when the electrical connector moves from the operative position to the retracted position.

In some embodiments, the linkage is positioned on the first side of the housing and the linkage includes an engagement surface that is accessible at the rear of the housing. The electrical connector is operatively connected to the linkage such that the electrical connector moves from the retracted position toward the operative position when the engagement surface receives an actuation force that is toward the front of the housing.

Embodiments include those wherein the electrical contact is positioned within a pocket of the electrical connector. The pocket includes an opening that faces upward when the electrical connector is in the operative position permitting the electrical connector in the image forming device to enter the pocket from above. In some embodiments, the electrical connector includes a vertical slit on an inner side of the pocket proximate to the reservoir for guiding a post on the corresponding electrical contact in the image forming device as the electrical connector moves upward from the retracted position to the operative position and downward from the operative position to the retracted position.

In some embodiments, when the electrical connector is in the retracted position, the electrical connector is tucked into a portion of the housing.

In some embodiments, at least a portion of the electrical contact is positioned higher than the outlet port when the electrical connector is in the operative position.

Embodiments include those wherein a channel runs along the front of the housing between the first side and the second side in fluid communication with the outlet port. At least a portion of the channel is open to the reservoir. An auger is positioned in the channel and extends along the front of the housing between the first side and the second side. The auger is operative to move toner in the channel toward the outlet port. The auger includes a rotational axis. In some embodiments, at least a portion of the electrical contact is positioned higher than the rotational axis of the auger when the electrical connector is in the operative position. Some embodiments include a toner delivery assembly positioned in the reservoir to deliver toner to the channel. The toner delivery assembly includes a drive shaft rotatably mounted in the reservoir. The drive shaft includes a rotational axis. In some embodiments, at least a portion of the electrical contact is positioned higher than the rotational axis of the drive shaft when the electrical connector is in the operative position.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
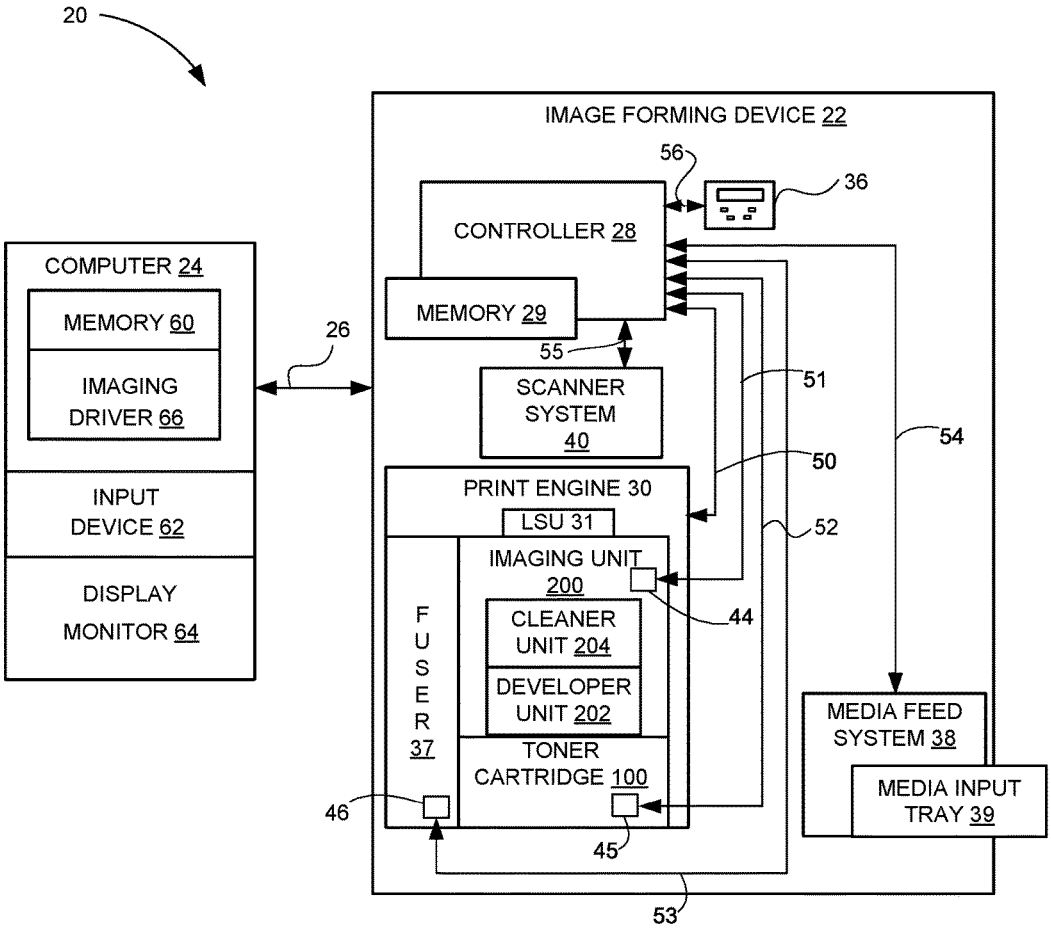
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 200, a toner cartridge 100, a user interface 36, a media feed system 38, a media input tray 39 and a scanner system 40. Image forming device 22 may communicate with computer 24 via a standard communication protocol, such as for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor may include one or more integrated circuits in the form of a microprocessor or central processing unit and may be formed as one or more Application-specific integrated circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 200 and processing circuitry 44 thereon via a communications link 51. Controller 28 communicates with toner cartridge 100 and processing circuitry 45 thereon via a communications link 52. Controller 28 communicates with a fuser 37 and processing circuitry 46 thereon via a communications link 53. Controller 28 communicates with media feed system 38 via a communications link 54. Controller 28 communicates with scanner system 40 via a communications link 55. User interface 36 is communicatively coupled to controller 28 via a communications link 56. Controller 28 processes print and scan data and operates print engine 30 during printing and scanner system 40 during scanning. Processing circuitry 44, 45, 46 may provide authentication functions, safety and operational interlocks, operating parameters and usage information related to imaging unit 200, toner cartridge 100 and fuser 37, respectively. Each of processing circuitry 44, 45, 46 includes a processor unit and associated electronic memory. As discussed above, the processor may include one or more integrated circuits in the form of a microprocessor or central processing unit and may be formed as one or more Application-specific integrated circuits (ASICs). The memory may be any volatile or non-volatile memory or combination thereof or any memory device convenient for use with processing circuitry 44, 45, 46.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100, imaging unit 200 and fuser 37, all mounted within image forming device 22. Imaging unit 200 is removably mounted in image forming device 22 and includes a developer unit 202 that houses a toner sump and a toner development system. In one embodiment, the toner development system utilizes what is commonly referred to as a single component development system. In this embodiment, the toner development system includes a toner adder roll that provides toner from the toner sump to a developer roll. A doctor blade provides a metered uniform layer of toner on the surface of the developer roll. In another embodiment, the toner development system utilizes what is commonly referred to as a dual component development system. In this embodiment, toner in the toner sump of developer unit 202 is mixed with magnetic carrier beads. The magnetic carrier beads may be coated with a polymeric film to provide triboelectric properties to attract toner to the carrier beads as the toner and the magnetic carrier beads are mixed in the toner sump. In this embodiment, developer unit 202 includes a magnetic roll that attracts the magnetic carrier beads having toner thereon to the magnetic roll through the use of magnetic fields. Imaging unit 200 also includes a cleaner unit 204 that houses a photoconductive drum and a waste toner removal system.

Toner cartridge 100 is removably mounted in imaging forming device 22 in a mating relationship with developer unit 202 of imaging unit 200. An outlet port on toner cartridge 100 communicates with an inlet port on developer unit 202 allowing toner to be periodically transferred from toner cartridge 100 to resupply the toner sump in developer unit 202.

The electrophotographic printing process is well known in the art and, therefore, is described briefly herein. During a printing operation, laser scan unit 31 creates a latent image on the photoconductive drum in cleaner unit 204. Toner is transferred from the toner sump in developer unit 202 to the latent image on the photoconductive drum by the developer roll (in the case of a single component development system) or by the magnetic roll (in the case of a dual component development system) to create a toned image. The toned image is then transferred to a media sheet received by imaging unit 200 from media input tray 39 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
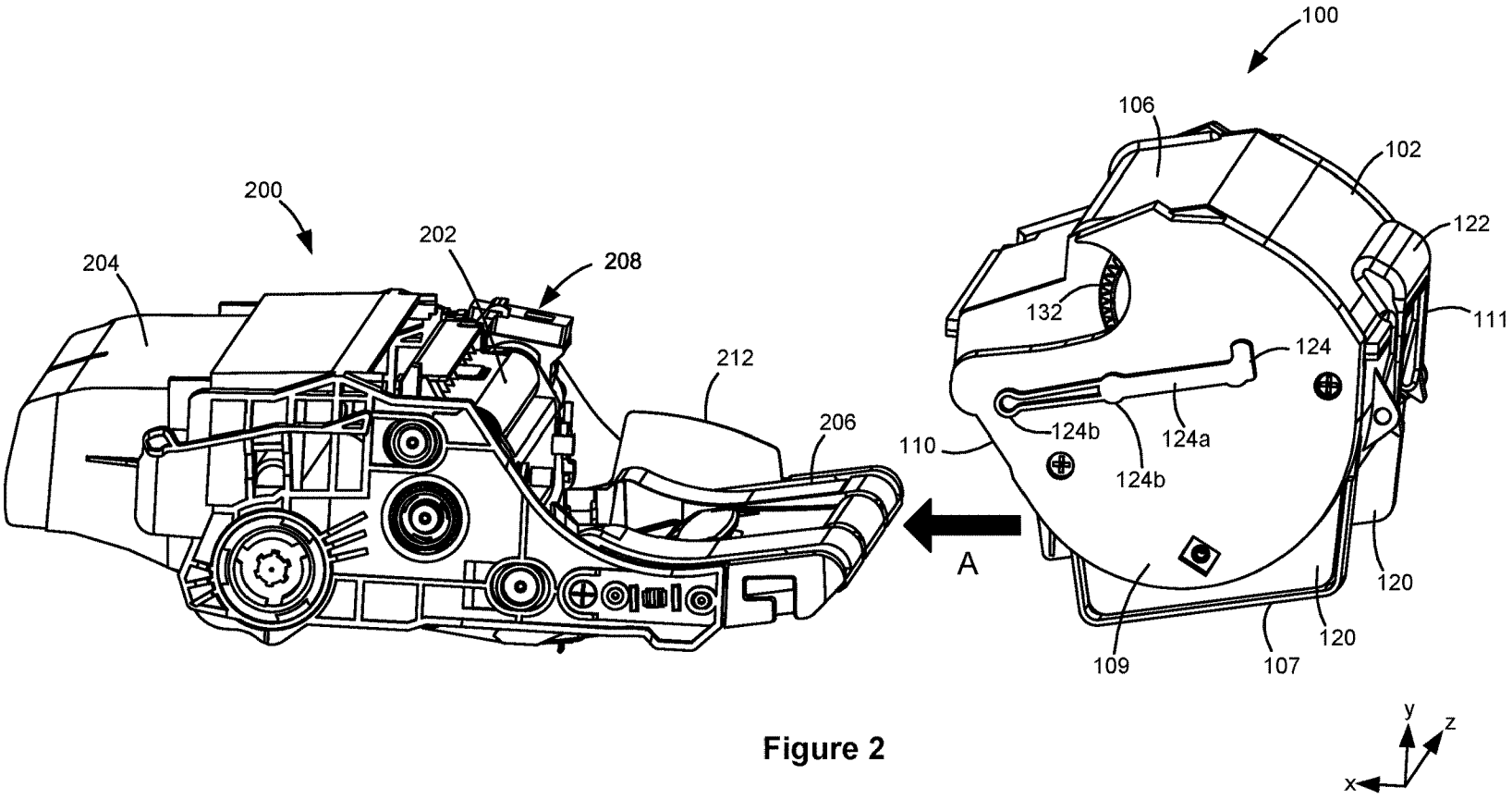
FIG. 2 is a perspective view of a toner cartridge and an imaging unit according to one example embodiment.

Referring now to FIG. 2, toner cartridge 100 and imaging unit 200 are shown according to one example embodiment. Imaging unit 200 includes a developer unit 202 and a cleaner unit 204 mounted on a common frame 206. Developer unit 202 includes a toner inlet port 208 positioned to receive toner from toner cartridge 100. As discussed above, imaging unit 200 and toner cartridge 100 are each removably installed in image forming device 22. Imaging unit 200 is first slidably inserted into image forming device 22. Toner cartridge 100 is then inserted into image forming device 22 and onto frame 206 in a mating relationship with developer unit 202 of imaging unit 200 as indicated by the arrow A shown in FIG. 2, which also indicates the direction of insertion of imaging unit 200 and toner cartridge 100 into image forming device 22. This arrangement allows toner cartridge 100 to be removed and reinserted easily when replacing an empty toner cartridge 100 without having to remove imaging unit 200. Imaging unit 200 may also be readily removed as desired in order to maintain, repair or replace the components associated with developer unit 202, cleaner unit 204 or frame 206 or to clear a media jam.

With reference to FIGS. 2-5, toner cartridge 100 includes a housing 102 having an enclosed reservoir 104 (FIG. 5) for storing toner. Housing 102 includes a top 106, a bottom 107, first and second sides 108, 109, a front 110 and a rear 111. Housing 102 includes a front-to-rear dimension (x-dimension in FIG. 2), a vertical dimension (y-dimension in FIG. 2) and a side-to-side dimension (z-dimension in FIG. 2). Front 110 of housing 102 leads during insertion of toner cartridge 100 into image forming device 22 and rear 111 trails. In one embodiment, each side 108, 109 of housing 102 includes an end cap 112, 113 mounted, e.g., by fasteners or a snap-fit engagement, to side walls 114, 115 of a main body 116 of housing 102. An outlet port 118 in fluid communication with reservoir 104 is positioned on front 110 of housing 102 near side 108 for exiting toner from toner cartridge 100. Housing 102 may include legs 120 on bottom 107 to assist with the insertion of toner cartridge 100 into image forming device 22 and to support housing 102 when toner cartridge 100 is set on a flat surface. A handle 122 may be provided on top 106 or rear 111 of housing 102 to assist with insertion and removal of toner cartridge 100 into and out of image forming device 22.

Figure 3:
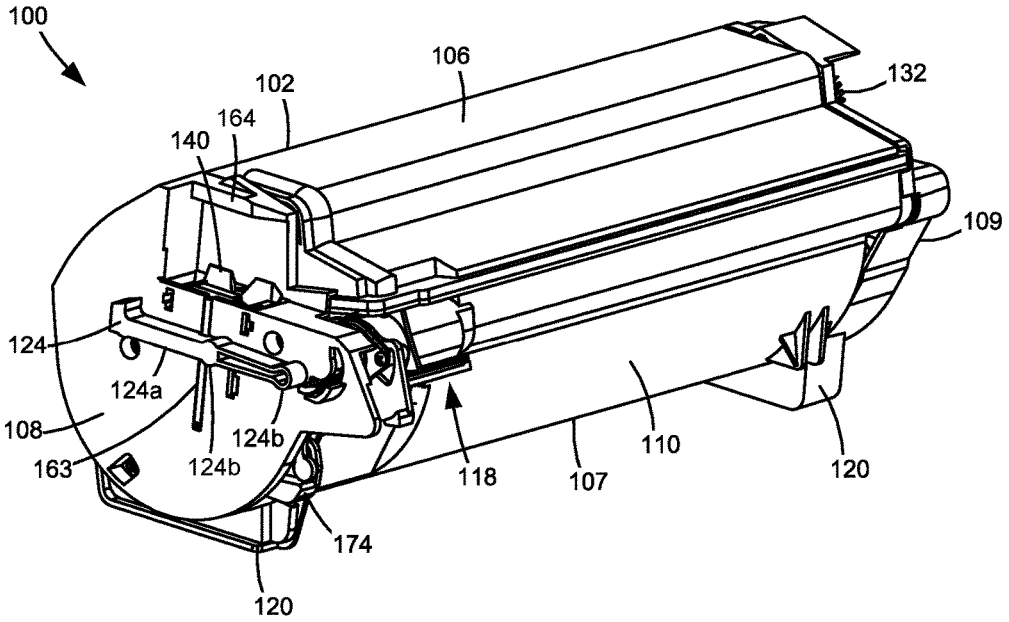
FIG. 3 is a front perspective view of the toner cartridge shown in FIG. 2.
Figure 4:
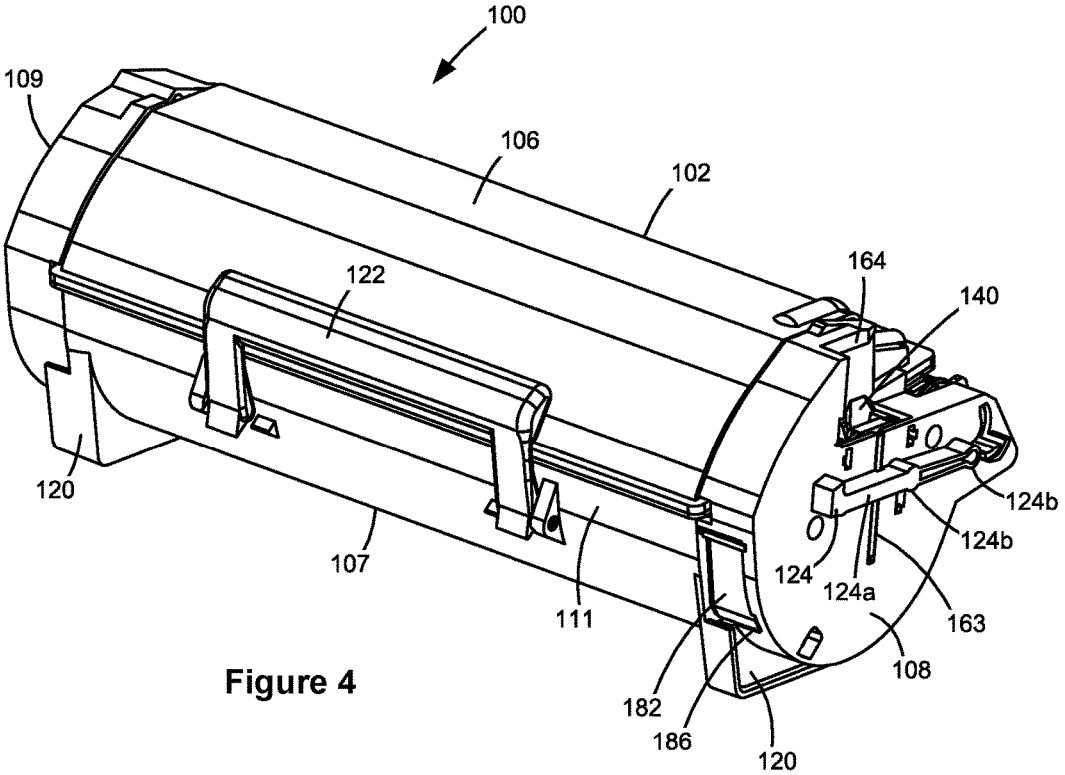
FIG. 4 is a rear perspective view of the toner cartridge shown in FIGS. 2 and 3.

Sides 108, 109 may each include an alignment guide 124 that extends outward from the respective side 108, 109 to assist the insertion of toner cartridge 100 into image forming device 22. Alignment guides 124 travel in corresponding guide slots in image forming device 22 that guide the insertion of toner cartridge 100 into image forming device 22. In the example embodiment illustrated, an alignment guide 124 is positioned on the outer side of each end cap 112, 113. Alignment guides 124 may run along the front-to-rear dimension of housing 102 as shown in FIGS. 2-4. In the example embodiment illustrated, each alignment guide 124 includes a wing member **124*a* that runs along the front-to-rear dimension of housing 102 on a respective side 108, 109 of housing 102. In the example embodiment illustrated, each alignment guide 124 also includes one or more rounded projections 124*b* formed on the bottom of wing member 124*a*. Rounded projections 124*b* define contact surfaces on the bottom of alignment guide 124 that ride on top of a corresponding guide surface as toner cartridge 100 is inserted into image forming device 22. However, alignment guide 124 may take many other suitable shapes and forms. For example, in another embodiment, alignment guide 124 includes one or more ribs on each side 108, 109 of housing 102 that extend along the front-to-rear dimension of housing 102. In another embodiment, alignment guide 124 includes one or more rounded pegs or projections from each side 108, 109, similar to rounded projections 124*b*, that may be spaced from each other along the front-to-rear dimension of housing 102**.

Figure 5:
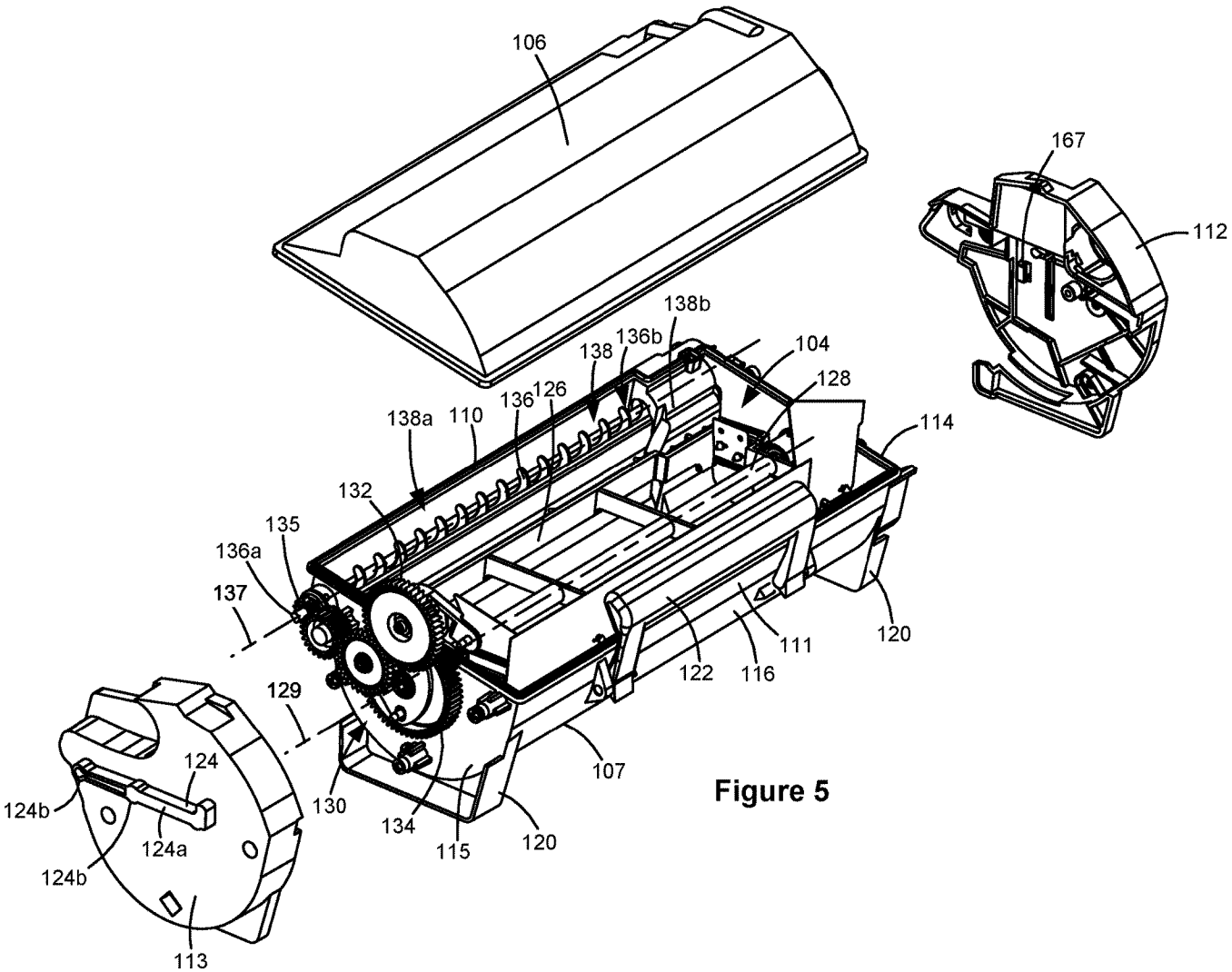
FIG. 5 is an exploded view of the toner cartridge shown in FIGS. 2-4 showing a reservoir for holding toner therein.

With reference to FIG. 5, a toner delivery assembly 126 is rotatably mounted within toner reservoir 104 with first and second ends of a drive shaft 128 of toner delivery assembly 126 extending through aligned openings in side walls 114, 115, respectively. Drive shaft 128 includes a rotational axis 129. Bushings may be provided on each end of drive shaft 128 where drive shaft 128 passes through side walls 114, 115. A drive train 130 is operatively connected to drive shaft 128 and may be positioned within a space formed between end cap 113 and side wall 115. Drive train 130 includes a main input gear 132 that engages with a drive system in image forming device 22 that provides torque to main input gear 132. As shown in FIG. 3, in one embodiment, a front portion of main input gear 132 is exposed at the front 110 of housing 102 near the top 106 of housing 102 where main input gear 132 engages the drive system in image forming device 22. With reference back to FIG. 5, drive train 130 also includes a drive gear 134 on one end of drive shaft 128 that is connected to main input gear 132 either directly or via one or more intermediate gears to rotate drive shaft 128.

An auger 136 having first and second ends 136*a*, 136*b* and a spiral screw flight is positioned in a channel 138 that runs along the front 110 of housing 102 from side 108 to side 109. Auger 136 includes a rotational axis 137. Channel 138 may be integrally molded as part of the front 110 of main body 116 or formed as a separate component that is attached to the front 110 of main body 116. Channel 138 is generally horizontal in orientation along with toner cartridge 100 when toner cartridge 100 is installed in image forming device 22. Outlet port 118 is positioned at the bottom of channel 138 so that gravity assists in exiting toner through outlet port 118. First end 136*a* of auger 136 extends through side wall 115 and a drive gear 135 of drive train 130 is provided on first end 136*a* that is connected to main input gear 132 either directly or via one or more intermediate gears. Channel 138 includes an open portion 138*a* and may include an enclosed portion 138*b*. Open portion 138*a* is open to toner reservoir 104 and extends from side 109 toward second end 136*b* of auger 136. Enclosed portion 138*b* of channel 138 extends from side 108 and encloses second end 136*b* of auger 136. In this embodiment, outlet port 118 is positioned at the bottom of enclosed portion 138*b* of channel 138.

Figure 6A:
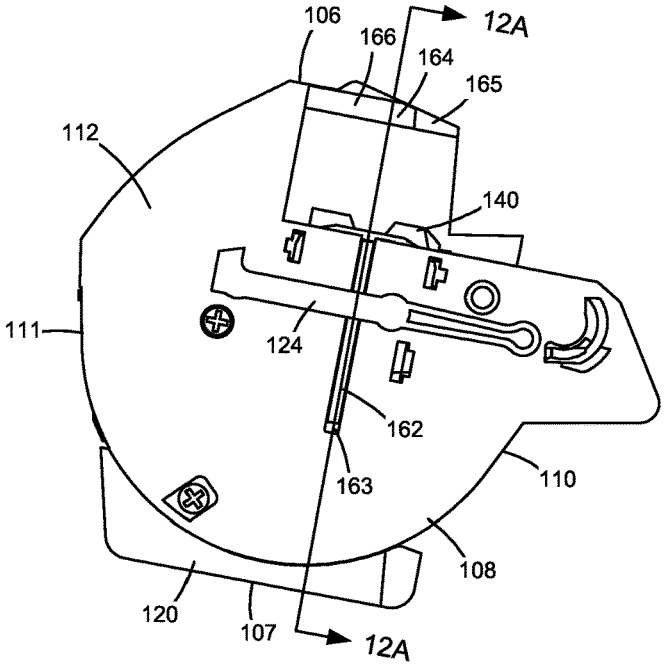
FIG. 6A is a side view of the toner cartridge showing an electrical connector in a retracted position according to one example embodiment.
Figure 6B:
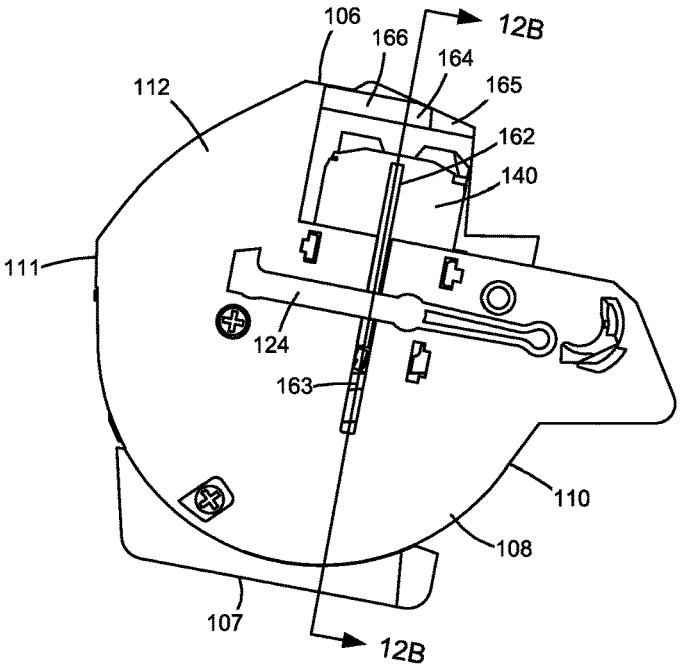
FIG. 6B is a side view of the toner cartridge showing the electrical connector in an operative position according to one example embodiment.

With reference to FIGS. 6A and 6B, toner cartridge 100 includes an electrical connector 140. In the example embodiment illustrated, electrical connector 140 is positioned on side 108 of housing 102. However, electrical connector 140 may be positioned in any suitable location on toner cartridge 100, such as, for example, on side 109, etc. Electrical connector 140 includes one or more electrical contacts 142 (FIG. 7) that are positioned to contact corresponding electrical contacts of an electrical connector in image forming device 22 when toner cartridge 100 is installed in image forming device 22. Electrical connector 140 is movable between a retracted position shown in FIG. 6A and an operative position shown in FIG. 6B in response to movement of an actuating linkage as discussed in greater detail below. In some embodiments, electrical connector 140 is biased toward the retracted position. In the example embodiment illustrated, electrical connector 140 moves upward toward top 106 of housing 102 as electrical connector 140 moves from the retracted position to the operative position and downward toward bottom 107 of housing 102 as electrical connector 140 moves from the operative position to the retracted position. However, electrical connector 140 may follow any suitable direction of travel from the retracted position to the operative position and vice versa, such as, for example, forward toward front 110, rearward toward rear 111, away from or toward side 108, etc. In the operative position, electrical connector 140 is positioned to establish contact between electrical contacts 142 and the corresponding electrical contacts of the electrical connector in image forming device 22. In the example embodiment illustrated, in the retracted position, electrical connector 140 is tucked inside of end cap 112, between end cap 112 and side wall 114, protecting electrical connector 140 from damage during insertion and removal of toner cartridge 100 into and out of image forming device 22. In the example embodiment illustrated, in the operative position, electrical connector 140 protrudes upward from end cap 112.

Figure 7:
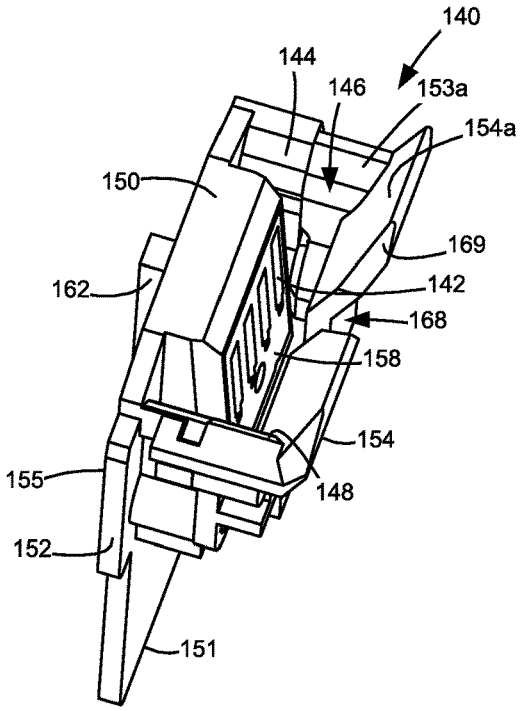
FIG. 7 is a front perspective view of the electrical connector according to one example embodiment.
Figure 8:
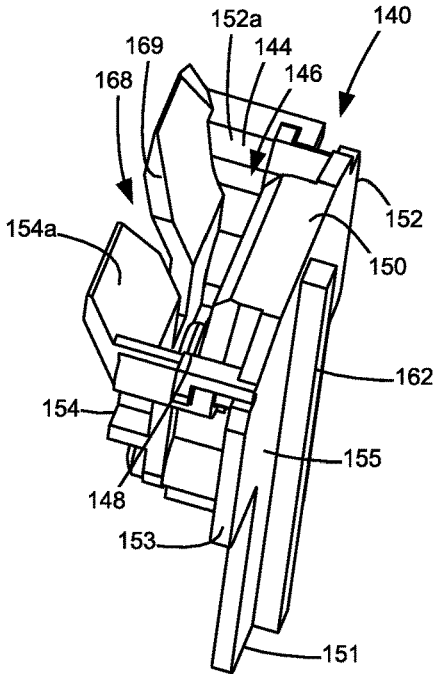
FIG. 8 is a rear perspective view of the electrical connector shown in FIG. 7.

Electrical connector 140 may include a male plug end of the connector interface or a female socket end of the connector interface with the electrical connector in the image forming device 22 forming the opposite female or male end of the connector interface. FIGS. 7 and 8 show electrical connector 140 according to one example embodiment. In this embodiment, electrical connector 140 includes a female socket 144. In this embodiment, electrical contacts 142 are positioned within a pocket 146 of electrical connector 140 that is sized to receive the corresponding male plug end of the electrical connector in image forming device 22. An opening 148 into pocket 146 permits the male plug end of the electrical connector in image forming device 22 to enter pocket 146 as electrical connector 140 moves from the retracted position to the operative position as discussed in greater detail below. Electrical connector 140 includes a top end 150 proximate to top 106, a bottom end 151 proximate to bottom 107, a front side 152 proximate to front 110 and a rear side 153 proximate to rear 111. Electrical connector 140 also includes an inner side 154 proximate to reservoir 104 and an outer side 155 that faces away from side 108.

A printed circuit board 158 is mounted on housing 102 and electrically connected to electrical contacts 142. Printed circuit board 158 includes processing circuitry 45, which may include a processor and associated memory as discussed above. For example, FIG. 7 shows printed circuit board 158 mounted within pocket 146 of electrical connector 140. In this embodiment, electrical contacts 142 are positioned on printed circuit board 158 and exposed within pocket 146 permitting electrical contacts 142 to contact the corresponding electrical contacts of the electrical connector in image forming device 22. However, printed circuit board 158 may be positioned in other suitable locations on toner cartridge 100, such as, for example, on an inner side of end cap 112 or an outer side of side wall 114, with the components of printed circuit board 158 electrically connected to electrical contacts 142 positioned in pocket 146, such as, for example, by suitable traces, cables or wires. In the example embodiment illustrated, electrical contacts 142 face toward inner side 154 of electrical connector 140.

Figure 9:
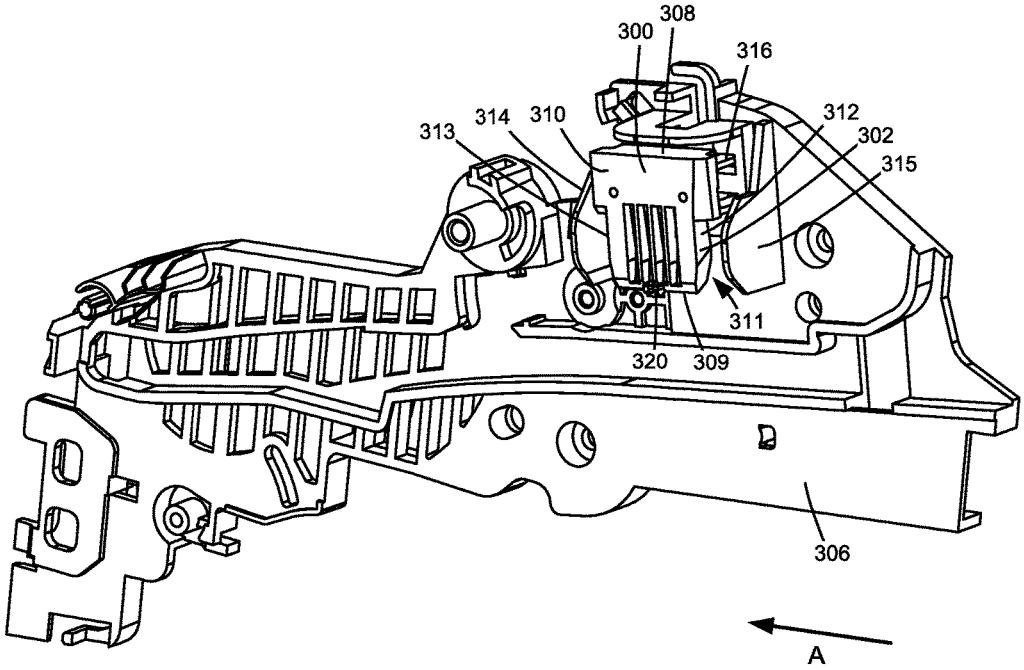
FIG. 9 is a perspective view of a frame and an electrical connector in an image forming device configured to operate with the electrical connector shown in FIGS. 7 and 8 according to one example embodiment.

FIG. 9 shows an electrical connector 300 in image forming device 22 according to one example embodiment that is configured to operate with electrical connector 140 shown in FIGS. 6A, 6B, 7 and 8. In the example embodiment illustrated, electrical connector 300 includes a male plug 302 end of the connector interface. However, as discussed above, electrical connector 300 may include a male or female connector depending on the configuration of electrical connector 140. Electrical connector 300 includes one or more electrical contacts 304 (FIGS. 12A and 12B) that contact corresponding electrical contacts 142 of electrical connector 140 when toner cartridge 100 is installed in image forming device 22 and electrical connector 140 is in its operative position. Electrical contacts 304 are electrically connected to controller 28 in order to permit communication between processing circuitry 45 and controller 28 when electrical contacts 142 mate with electrical contacts 304.

Electrical connector 300 is mounted to a frame 306 of image forming device 22 at a position to engage electrical connector 140 when toner cartridge 100 is installed in image forming device 22 and electrical connector 140 is in its operative position. Frame 306 extends along the direction of insertion of toner cartridge 100 into image forming device 22, which is indicated by the arrow A in FIG. 9. In the example embodiment illustrated, electrical connector 300 is positioned adjacent to side 108 when toner cartridge 100 is installed in image forming device 22.

Electrical connector 300 includes a top end 308, a bottom end 309, an inner side 310 that faces away from frame 306 and toward toner cartridge 100 and an outer side 311 that faces toward frame 306 and away from toner cartridge 100. Electrical connector 300 also includes a leading end 312 positioned closer to the direction from which toner cartridge 100 enters image forming device 22 and a trailing end 313 positioned farther from the direction from which toner cartridge 100 enters image forming device 22 such that toner cartridge 100 reaches leading end 312 before reaching trailing end 313 as toner cartridge 100 is inserted into image forming device 22. In the embodiment illustrated, a front wall 314 is positioned past trailing end 313 of electrical connector 300 along the direction of insertion of toner cartridge 100. A rear wall 315 is positioned ahead of leading end 312 of electrical connector 300 along the direction of insertion of toner cartridge 100. Front wall 314 and rear wall 315 extend away from frame 306, toward toner cartridge 100. Front wall 314 and rear wall 315 shield electrical connector 300 from contact at trailing end 313 and leading end 312 of electrical connector 300, respectively. In this manner, front wall 314 and rear wall 315 protect electrical connector 300 from accidental contact with imaging unit 200 or toner cartridge 100, which may result in damage to electrical connector 300, during insertion or removal of imaging unit 200 or toner cartridge 100 into or out of image forming device 22. Front wall 314 and rear wall 315 also protect electrical connector 300 from damage when the area inside image forming device 22 that houses imaging unit 200 and toner cartridge 100 is serviced or repaired including, for example, when jammed media is removed from this area. In the embodiment illustrated, electrical contacts 304 are positioned on outer side 311 of electrical connector 300 near frame 306 such that inner side 310 of electrical connector 300 and frame 306 further shield electrical contacts 304 from damage.

Figure 12A:
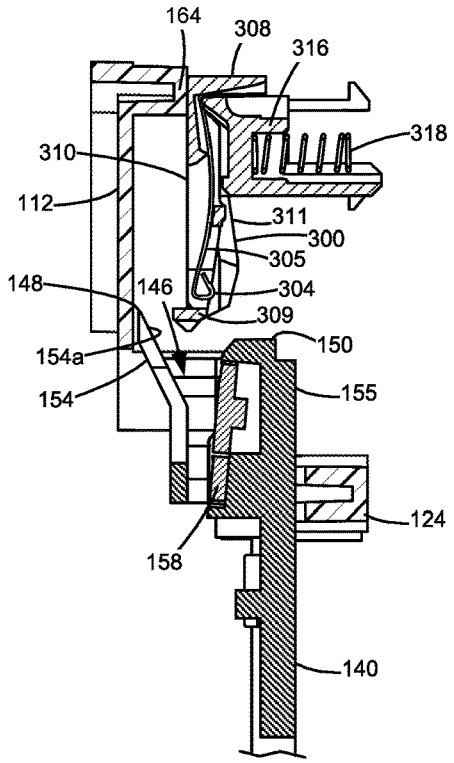
FIG. 12A is a cross-sectional view of the electrical connector of the toner cartridge aligned with the electrical connector in the image forming device when the electrical connector of the toner cartridge is in the retracted position shown in FIG. 11A.
Figure 12B:
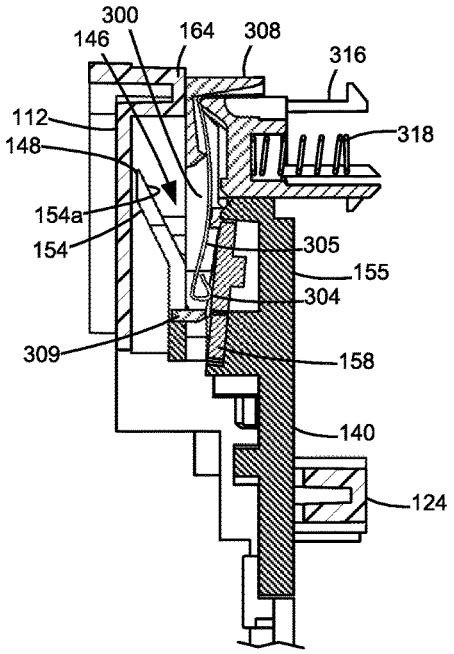
FIG. 12B is a cross-sectional view of the electrical connector of the toner cartridge mated with the electrical connector in the image forming device when the electrical connector of the toner cartridge is in the operative position shown in FIG. 11B.

Electrical connector 300 is attached to frame 306 by a support arm 316 (also shown in FIGS. 12A and 12B) that extends in a cantilevered manner outward from frame 306, toward toner cartridge 100. Electrical connector 300 and support arm 316 are movable to a limited degree toward and away from frame 306 (in the side-to-side dimension of housing 102) and along the insertion direction of toner cartridge 100 (in the front-to-rear dimension of housing 102). In one embodiment, electrical connector 300 and support arm 316 are biased away from frame 306, toward toner cartridge 100, such as, for example, by a compression spring 318 (FIGS. 12A and 12B). The bias on electrical connector 300 and the freedom of movement of electrical connector 300 aid in aligning electrical connector 300 with electrical connector 140 as discussed below.

Figure 10A:
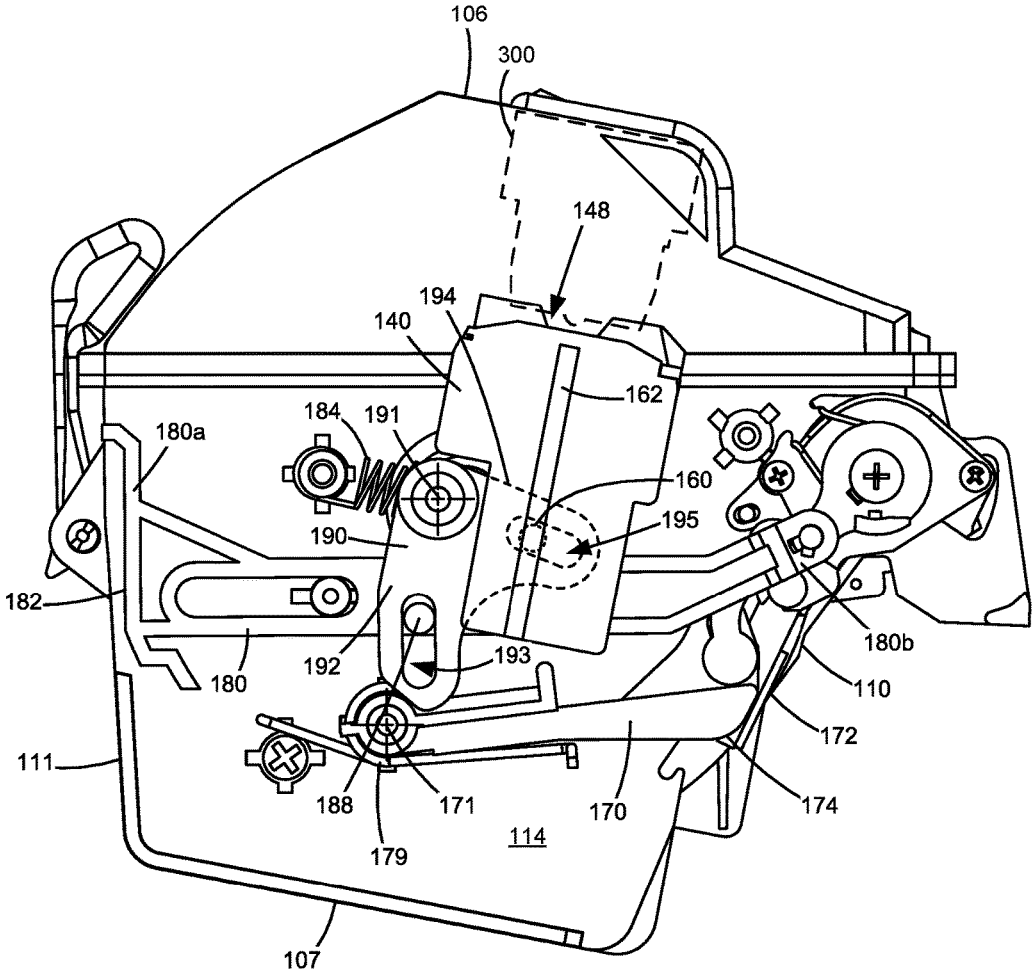
FIG. 10A is a side view of the toner cartridge with the electrical connector in the retracted position and an end cap removed to shown an actuation linkage according to one example embodiment.
Figure 10B:
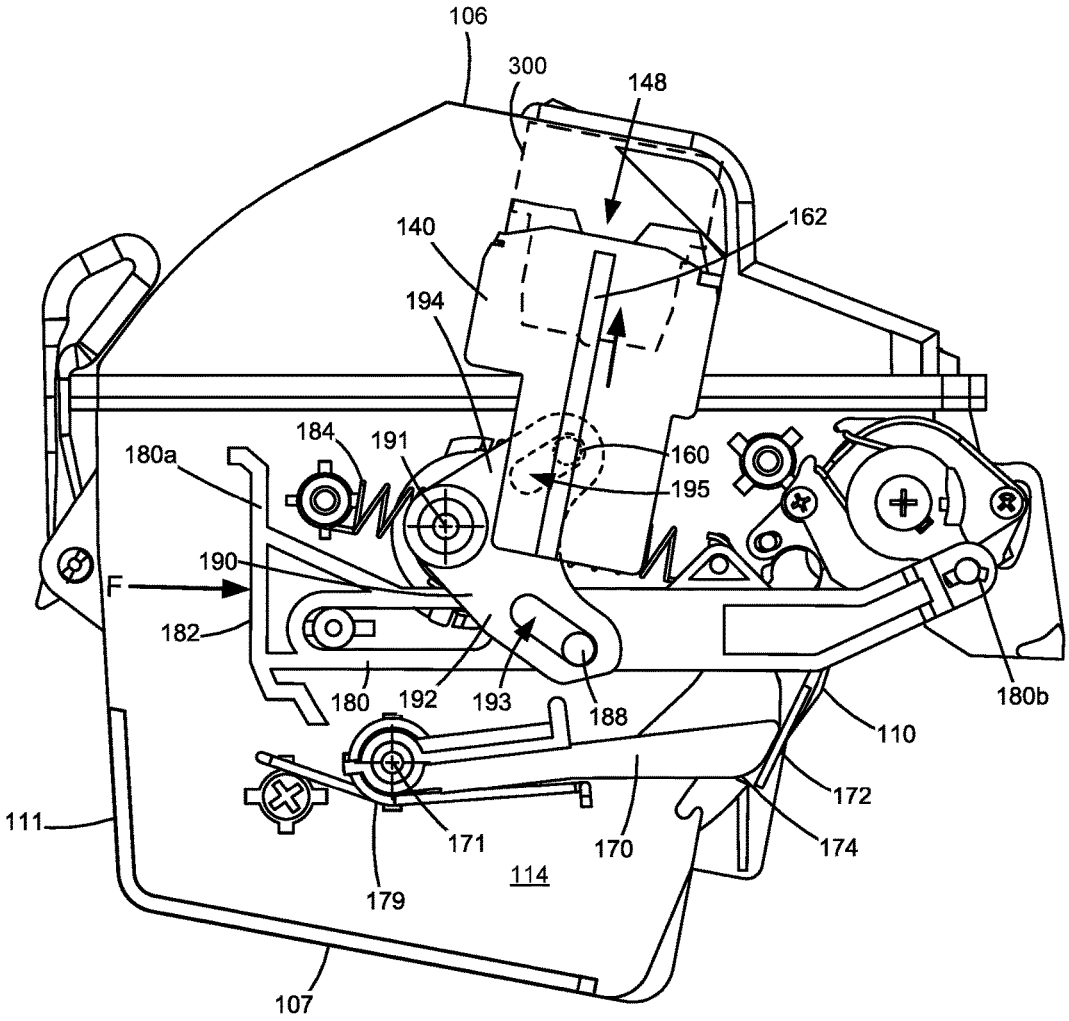
FIG. 10B is a side view of the toner cartridge shown in FIG. 10A with the electrical connector in the operative position and the end cap removed.

FIGS. 10A and 10B show toner cartridge 100 with end cap 112 removed to more clearly illustrate the actuation of electrical connector 140 according to one example embodiment. FIG. 10A shows electrical connector 140 in its retracted position and FIG. 10B shows electrical connector 140 in its operative position. Electrical connector 300 is shown schematically in dashed lines in FIGS. 10A and 10B to aid in illustrating the positioning of electrical connector 140 relative to electrical connector 300. In the embodiment illustrated, toner cartridge 100 includes an actuation linkage 180 positioned between end cap 112 and side wall 114 that is operatively connected to electrical connector 140 such that movement of linkage 180 causes electrical connector 140 to move between its retracted and operative positions. Linkage 180 is an elongated member that extends from a rear end 180*a* to a front end 180*b* of linkage 180. In the embodiment illustrated, linkage 180 is movable forward toward front 110 and rearward toward rear 111 of housing 102. In this embodiment, forward movement of linkage 180 toward front 110 causes electrical connector 140 to move from its retracted position to its operative position and rearward movement of linkage 180 toward rear 111 causes electrical connector 140 to move from its operative position to its retracted position. Rear end 180*a* of linkage 180 is exposed at the rear 111 of toner cartridge 100 to receive an actuation force from an actuation member, such as a plunger, rib, projection, arm, etc., operatively coupled to an access door of image forming device 22 as explained in greater detail below. For example, in the embodiment illustrated, rear end 180*a* of linkage 180 is exposed through an opening 186 (FIG. 4) on the rear 111 of end cap 112. In the example embodiment illustrated, rear end 180*a* of linkage 180 includes an engagement surface 182, such as a button-like area or contact face, that engages the actuation member of image forming device 22.

In the embodiment illustrated, linkage 180 is biased by one or more biasing members, such as an extension spring 184, toward rear 111 of housing 102 where engagement surface 182 is exposed, i.e., toward the position shown in FIG. 10A. Linkage 180 is translatable in the forward direction shown by arrow F in FIG. 10B when engagement surface 182 is depressed and the biasing force is overcome. In the embodiment illustrated, the rearward bias on linkage 180 also biases electrical connector 140 toward its retracted position. Alternatively, electrical connector 140 may be independently biased toward its retracted position. Although the example embodiment illustrated shows electrical connector 140 biased toward the retracted position by an extension spring 184, any suitable biasing member may be used as desired, such as, for example, a compression spring, a leaf spring, a torsion spring or another member composed of a material having resilient properties.

Linkage 180 may be operatively connected to electrical connector 140 by any suitable construction such that the movement of linkage 180 causes electrical connector 140 to move between its retracted and operative positions. For example, in the embodiment illustrated, linkage 180 is operatively connected to electrical connector 140 by an intermediate linkage 190. Linkage 190 is pivotable about a pivot point 191. Linkage 190 includes a first arm 192 and a second arm 194, each extending radially from pivot point 191. Arm 192 is connected to linkage 180 such that forward and rearward movement of linkage 180 causes linkage 190 to pivot about pivot point 191. In the embodiment illustrated, linkage 180 includes a post 188 that is received by an elongated slot 193 on arm 192 of linkage 190. Similarly, in the embodiment illustrated, electrical connector 140 includes a post 160 that is received by an elongated slot 195 on arm 194 of linkage 190. The elongated shapes of slots 193 and 195 accommodate the pivotal movement of arms 192 and 194 around pivot point 191 as linkage 180 moves forward and rearward and electrical connector 140 moves between its retracted and operative positions. Of course, these configurations may be reversed as desired so that arm 192 and/or arm 194 includes a post and linkage 180 and/or electrical connector 140 includes a corresponding elongated slot.

In some embodiments, front end 180*b* of linkage is operatively connected to a shutter (not shown) that is movable between an open position and a closed position. In the open position, the shutter permits toner to flow from outlet port 118. In the closed position, the shutter blocks outlet port 118 preventing toner from escaping toner cartridge 100.

In some embodiments, a raisable linkage 170 is positioned between end cap 112 and side wall 114 that opens and closes a cover 172 on outlet port 118 as described and illustrated in U.S. Pat. No. 8,649,710 titled "Toner Cartridge having a Pivoting Exit Port Cover." Cover 172 is pivotable between a closed position where a sealing face of cover 172 is pressed against an outer portion of outlet port 118 to trap any residual toner within outlet port 118 and an open position (shown in FIGS. 10A and 10B) where cover 172 is pivoted away from outlet port 118 and positioned against the front 110 of housing 102 below outlet port 118 with the sealing face of cover 172 facing forward away from the front 110 of housing 102. Linkage 170 is pivotable about an axis of rotation 171. Linkage 170 extends along side wall 114 from its axis of rotation 171 toward the front 110 of housing 102. Linkage 170 includes an engagement surface 174 that is exposed at the front 110 of housing 102, such as at a front portion of end cap 112 next to side wall 114 as shown in FIG. 3. In one embodiment, linkage 170 is operatively connected to cover 172 to move cover 172 from the closed position to the open position when engagement surface 174 contacts a corresponding engagement feature on imaging unit 200 as toner cartridge 100 is inserted into image forming device 22. In the example embodiment illustrated, linkage 170 is biased downward, i.e., in a clockwise direction as viewed in FIGS. 10A and 10B, by one or more biasing members, such as a torsion spring 179, to close cover 172. When toner cartridge 100 is inserted into image forming device 22, engagement surface 174 of linkage 170 contacts a fin or other engagement feature 212 on frame 206 of imaging unit 200 (FIG. 2). The contact between engagement feature 212 and engagement surface 174 causes linkage 170 to pivot upward in a counter-clockwise direction as viewed in FIGS. 10A and 10B. The upward pivot of linkage 170 causes cover 172 to pivot from the closed position to the open position. When toner cartridge 100 is separated from imaging unit 200, this sequence is reversed such that the bias on linkage 170 causes linkage 170 to pivot downward in a clockwise direction as viewed in FIGS. 10A and 10B causing cover 172 to pivot closed.

During installation of toner cartridge 100 into image forming device 22, electrical connector 140 is in its retracted position as a result of the bias on electrical connector 140 and protected by end cap 112 from damage in case toner cartridge 100 is misaligned as toner cartridge 100 is inserted into image forming device 22. As discussed above, electrical connector 300 is protected from damage from toner cartridge 100 by front and rear walls 314, 315 and electrical contacts 304 of electrical connector 300 are further protected by inner side 310 of electrical connector 300. FIG. 10A illustrates toner cartridge 100 installed in its final position in image forming device 22 with the access door to image forming device 22 open. Linkage 180 is shown biased rearward with engagement surface 182 exposed at rear 111 of housing 102. Electrical connector 140 is in its retracted position and positioned below electrical connector 300 in image forming device 22 with opening 148 of pocket 146 aligned with electrical connector 300. As shown in FIG. 10B, when the access door to image forming device 22 is closed, an actuation member, such as a plunger, rib, projection, arm, etc., extending from an inner side of the access door (or otherwise linked to the access door), presses engagement surface 182 overcoming the biasing force on linkage 180 and moving linkage 180 forward toward front 110. The forward movement of linkage 180 causes linkage 190 to pivot counterclockwise as viewed in FIG. 10B causing electrical connector 140 to move upward to its operative position. In the embodiment illustrated, electrical connector 140 translates upward along a substantially straight line as electrical connector 140 moves to the operative position. In the embodiment illustrated, at least a portion of electrical connector 140 including at least a portion of each electrical contact 142 is positioned higher than rotational axis 129 of drive shaft 128, outlet port 118 and rotational axis 137 of auger 136 when electrical connector 140 is in its operative position. As electrical connector 140 moves upward to its operative position, electrical connector 300 enters pocket 146 of electrical connector 140. As electrical connector 140 nears its operative position, electrical contacts 142 of electrical connector 140 contact corresponding electrical contacts 304 of electrical connector 300. The contact between electrical contacts 304 and electrical contacts 142 facilitates communication between controller 28 of image forming device 22 and processing circuitry 45 of toner cartridge 100.

This sequence is reversed when the access door to image forming device 22 is opened to remove toner cartridge 100 from image forming device 22. When the access door is opened, the actuation member on the inner side of the access door moves away from toner cartridge 100 causing linkage 180 to move rearward as a result of the bias on linkage 180. In turn, linkage 190 pivots clockwise as viewed in FIG. 10B causing electrical connector 140 to move downward, separate from electrical connector 300 and return to its retracted position. In the embodiment illustrated, electrical connector 140 translates downward along a substantially straight line as electrical connector 140 moves to the retracted position.

With reference back to FIGS. 6A, 6B and 8, in the example embodiment illustrated, electrical connector 140 includes a rib 162 that extends outward from outer side 155 of electrical connector 140 and runs vertically between top end 150 and bottom end 151 of electrical connector 140. Rib 162 is received in a corresponding vertical slit 163 in end cap 112. The engagement between rib 162 and slit 163 guides the upward and downward movement of electrical connector 140 between the retracted position and the operative position and restrains electrical connector 140 from moving along the front-to-rear dimension of housing 102. In one embodiment, an inner side of end cap 112 includes tabs 167 (FIG. 5) adjacent to inner side 154 of electrical connector 140 that restrain electrical connector 140 from moving along the side-to-side dimension of housing 102. However, it will be appreciated that electrical connector 140 may be restrained from moving along the front-to-rear and side-to-side dimensions of housing 102 by any suitable construction including the use of tabs, flanges, ribs, walls or the like on electrical connector 140, end cap 112 and/or side wall 114. Alternatively, the configuration of electrical connector 140 and electrical connector 300 may be reversed such that electrical connector 140 is movable to a limited degree along the front-to-rear and side-to-side dimensions of housing 102 and electrical connector 300 is restrained from moving along the front-to-rear and side-to-side dimensions of housing 102.

Figure 11A:
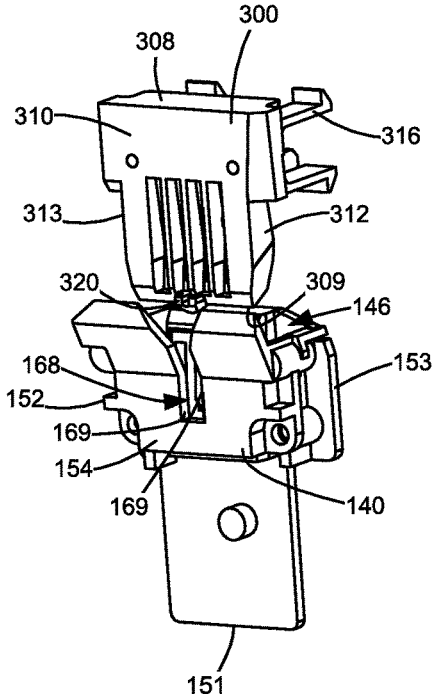
FIG. 11A is a perspective view of the electrical connector of the toner cartridge aligned with the electrical connector in the image forming device when the electrical connector of the toner cartridge is in the retracted position according to one example embodiment.

FIGS. 11A-12B illustrate the mating and alignment of electrical connector 140 with electrical connector 300 as electrical connector 140 moves to its operative position according to one example embodiment. FIGS. 11A and 12A show electrical connector 140 in its retracted position and FIGS. 11B and 12B show electrical connector 140 in its operative position. FIGS. 12A and 12B are cross-sectional views taken along lines 12A-12A and 12B-12B in FIGS. 6A and 6B, respectively, with electrical connector 300 added. In the example embodiment illustrated, as toner cartridge 100 is inserted into image forming device 22, a rib 164 on side 108 of housing 102 contacts a top portion of inner side 310 of electrical connector 300 tilting bottom end 309 of electrical connector 300 away from frame 306 and toward toner cartridge 100. FIGS. 3, 6A and 6B show rib 164 in greater detail. Rib 164 is positioned above electrical connector 140 in both the retracted and operative positions of electrical connector 140. In the embodiment illustrated, rib 164 is positioned on an outer side of end cap 112. In other embodiments, rib 164 is positioned on an outer side of end wall 114. Rib 164 includes a ramped surface 165 that tapers outward sideways in a direction from front 110 to rear 111 along the front-to-rear dimension of housing 102. Rib 164 may also include a planar surface 166 positioned rearward from ramped surface 165. Planar surface 166 has a substantially constant position in the side-to-side dimension of housing 102. As toner cartridge 100 is inserted into image forming device 22, ramped surface 165 of rib 164 contacts the top portion of inner side 310 of electrical connector 300. The incline of ramped surface 165 causes electrical connector 300 to gradually pivot upward as toner cartridge 100 moves forward causing bottom end 309 of electrical connector 300 to tilt away from frame 306 and toward toner cartridge 100. As toner cartridge 100 continues to advance into image forming device 22, planar surface 166 contacts the top portion of inner side 310 of electrical connector 300 maintaining the position of bottom end 309 of electrical connector 300 relative to toner cartridge 100.

With reference back to FIGS. 11A-12B, once toner cartridge 100 is installed in image forming device 22, as the access door to image forming device 22 is closed and the actuation member linked to the access door moves linkage 180 forward, electrical connector 140 moves from its retracted position toward its operative position. As electrical connector 140 moves toward the operative position, top end 150 of electrical connector 140 approaches bottom end 309 of electrical connector 300. In the embodiment illustrated, an inner pocket surface 154*a* of inner side 154 at top end 150 of electrical connector 140 forming opening 148 to pocket 146 tapers outward sideways relative to housing 102 in a direction from top end 150 to bottom end 151. FIGS. 7 and 8 also illustrate the taper of inner pocket surface 154*a*. Bottom end 309 is positioned to contact inner pocket surface 154*a* of inner side 154 as electrical connector 140 moves upward toward its operative position as a result of the tilting of bottom end 309 of electrical connector 300 away from frame 306 by rib 164. As electrical connector 140 continues to move upward, the taper of inner pocket surface 154*a* of inner side 154 of electrical connector 140 guides bottom end 309 of electrical connector 300 sideways relative to housing 102 aligning electrical connector 300 with electrical connector 140 in the side-to-side dimension of housing 102. The taper of inner pocket surface 154*a* of inner side 154 gradually moves bottom end 309 of electrical connector 300 toward electrical contacts 142 as electrical connector 140 moves upward. Inner side 310 and outer side 311 of electrical connector 300 may also be tapered at bottom end 309 in order to facilitate entry of bottom end 309 into opening 148 of pocket 146. A width of pocket 146 in the side-to-side dimension of housing 102 is sized to closely receive electrical connector 300 in order to ensure that electrical contacts 304 make sufficient physical contact with electrical contacts 142 when electrical connector 140 reaches its operative position. Further, as shown in FIGS. 12A and 12B, in the example embodiment illustrated, electrical contacts 304 include prongs 305 that are composed of a resilient material and are positioned to have an interference contact with electrical contacts 142 when electrical connector 300 mates with electrical connector 140. Accordingly, when electrical connector 300 mates with electrical connector 140, electrical contacts 304 are deflected by and biased against electrical contacts 142 in order to maintain sufficient contact between electrical contacts 304 and electrical contacts 142.

With reference to FIGS. 7 and 8, in the embodiment illustrated, inner pocket surfaces 152*a* and 153*a* of front side 152 and rear side 153 at top end 150 of electrical connector 140 forming opening 148 to pocket 146 taper inward toward each other in a direction from top end 150 to bottom end 151. Specifically, inner pocket surface 152*a* of front side 152 tapers rearward toward rear side 153 in a direction from top end 150 to bottom end 151 and inner pocket surface 153*a* of rear side 153 tapers forward toward front side 152 in a direction from top end 150 to bottom end 151. As electrical connector 140 moves upward toward its operative position, the taper of inner pocket surfaces 152*a* and 153*a* of front side 152 and rear side 153 of electrical connector 140 guide bottom end 309 of electrical connector 300 into opening 148 of pocket 146 and align electrical connector 300 with electrical connector 140 in the front-to-rear dimension of housing 102. Leading end 312 and trailing end 313 of electrical connector 300 may also be tapered at bottom end 309 in order to facilitate entry of bottom end 309 into opening 148 of pocket 146.

Figure 11B:
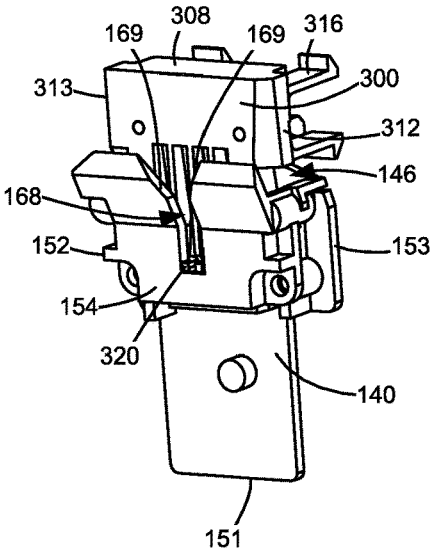
FIG. 11B is a perspective view of the electrical connector of the toner cartridge mated with the electrical connector in the image forming device when the electrical connector of the toner cartridge is in the operative position according to one example embodiment.

With reference to FIGS. 11A and 11B, in the embodiment illustrated, electrical connector includes a slit 168 on inner side 154 that runs vertically between top end 150 and bottom end 151 of electrical connector 140. Slit 168 is open at top end 150 to receive a corresponding post 320 on inner side 310 of electrical connector 300. Post 320 extends outward away from inner side 310 and is positioned at or near bottom end 309 of electrical connector 300. Walls 169 forming slit 168 taper toward each other in a direction from top end 150 to bottom end 151 such that a width of slit 168 measured between front side 152 and rear side 153 narrows from top to bottom to a point where slit 168 is slightly wider than post 320. As electrical connector 140 moves upward toward its operative position, contact between post 320 and walls 169 of slit 168 further aligns electrical connector 300 with electrical connector 140 in the front-to-rear dimension of housing 102. As electrical connector 140 nears its operative position, the narrowing width of slit 168 finely controls the position of electrical connector 300 relative to electrical connector 140 in the front-to-rear dimension of housing 102 in order to ensure that electrical contacts 304 line up with electrical contacts 142. Of course, this configuration may be reversed as desired so that electrical connector 140 includes a post and electrical connector 300 includes a slit that narrows in a direction from bottom end 309 to top end 308.

Movement of electrical connector 140 to its operative position aligns electrical connector 140 vertically with electrical connector 300. Further, in the embodiment illustrated, each electrical contact 142 is vertically elongated in order to allow for slight vertical misalignment between electrical connector 140 and electrical connector 300.

Electrical connector 140 and electrical connector 300 are not limited to the example embodiment illustrated. Those skilled in the art will appreciate that electrical connector 140 and electrical connector 300 may include any suitable alignment features that align electrical connector 140 and electrical connector 300 with each other to ensure sufficient contact between electrical contacts 142 and electrical contacts 304 when electrical connector 140 is in its operative position with toner cartridge 100 installed in image forming device 22. Further, although the example embodiment discussed above includes an electrical connector 140 that translates along a substantially straight line as electrical connector 140 moves between the retracted and operative positions, electrical connector 140 may take other paths of travel as desired. For example, in another embodiment, electrical connector 140 pivots upward, e.g., about an axis that is parallel to drive shaft 128, as electrical connector 140 moves toward its operative position and pivots downward as electrical connector 140 moves toward its retracted position. As mentioned above, electrical connector 140 may take directions of travel other than upward and downward between the retracted position and the operative position.

Further, the actuation of electrical connector 140 is not limited to the example embodiment illustrated. For example, linkage 180 and/or linkage 190 may take other suitable forms to move electrical connector 140 between its operative and retracted positions and more or fewer linkages may be used as desired. In other embodiments, electrical connector 140 is manually actuated by a user instead of automatically upon the closing of an access door of image forming device 22. For example, a lever, dial or push-button may be exposed on the exterior of housing 102, e.g., on rear 111, that is manually actuated by a user after toner cartridge 100 is installed in image forming device 22 in order to move electrical connector 140 from the retracted position to the operative position. In other embodiments, electrical connector 140 is automatically actuated by an element of image forming device 22 other than the closing of an access door of image forming device 22. For example, in one embodiment, electrical connector 140 is actuated by the movement of linkage 170 actuated by engagement feature 212 on frame 206 of imaging unit 200.

Although the example embodiments discussed above include an electrical connector, such as electrical connector 140, positioned on toner cartridge 100, it will be appreciated that an electrical connector that is movable between a retracted position and an operative position may be used on any replaceable unit of image forming device 22, such as, for example, imaging unit 200 and/or fuser 37 in order to establish communication between controller 28 and processing circuitry 44 and/or processing circuitry 46. Further, although the example embodiment shown in FIG. 2 includes a pair of replaceable units in the form of toner cartridge 100 and imaging unit 200, it will be appreciated that the replaceable unit(s) of image forming device 22 may employ any suitable configuration as desired. For example, in one embodiment, the main toner supply for image forming device 22, developer unit 202, and cleaner unit 204 are housed in one replaceable unit. In another embodiment, the main toner supply for image forming device 22 and developer unit 202 are provided in a first replaceable unit and cleaner unit 204 is provided in a second replaceable unit. Further, although the example image forming device 22 discussed above includes one toner cartridge 100 and corresponding imaging unit 200, in the case of an image forming device configured to print in color, separate replaceable units may be used for each toner color needed. For example, in one embodiment, the image forming device includes four toner cartridges and four corresponding imaging units, each toner cartridge containing a particular toner color (e.g., black, cyan, yellow and magenta) and each imaging unit corresponding with one of the toner cartridges to permit color printing.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner cartridge for use in an electrophotographic image forming device, comprising:

a housing having a top, a bottom, a front and a rear positioned between a first side and a second side of the housing, the housing has a reservoir for holding toner;

an outlet port in fluid communication with the reservoir and facing downward on the front of the housing for exiting toner from the toner cartridge;

an electrical connector on the first side of the housing, the electrical connector is movable between a retracted position and an operative position, the electrical connector includes an electrical contact for contacting a corresponding electrical contact in the image forming device when the electrical connector is in the operative position, the electrical connector and the electrical contact of the toner cartridge move upward toward the top of the housing when the electrical connector moves from the retracted position to the operative position, the electrical connector and the electrical contact of the toner cartridge move downward toward the bottom of the housing when the electrical connector moves from the operative position to the retracted position, the electrical contact of the toner cartridge is electrically connected to processing circuitry mounted on the housing, the electrical contact of the toner cartridge is positioned within a pocket of the electrical connector, the pocket includes an opening that faces upward when the electrical connector is in the operative position permitting the corresponding electrical contact in the image forming device to enter the pocket from above; and a linkage operatively connected to the electrical connector, the linkage includes an engagement surface that is accessible on an exterior of the housing to receive an actuation force, wherein movement of the linkage moves the electrical connector between the retracted position and the operative position.

2. The toner cartridge of claim 1, wherein the electrical connector is biased by a biasing member toward the retracted position.

3. The toner cartridge of claim 1, wherein the electrical connector translates upward toward the top of the housing when the electrical connector moves from the retracted position to the operative position and the electrical connector translates downward toward the bottom of the housing when the electrical connector moves from the operative position to the retracted position.

4. The toner cartridge of claim 1, wherein the linkage is positioned on the first side of the housing and the engagement surface is accessible at the rear of the housing.

5. The toner cartridge of claim 1, wherein the electrical connector includes a vertical slit on an inner side of the pocket proximate to the reservoir for guiding a post on the corresponding electrical contact in the image forming device as the electrical connector moves upward from the retracted position to the operative position and downward from the operative position to the retracted position.

6. The toner cartridge of claim 1, wherein when the electrical connector is in the retracted position, the electrical connector is tucked into a portion of the housing.

7. The toner cartridge of claim 1, wherein at least a portion of the electrical contact of the toner cartridge is positioned higher than the outlet port when the electrical connector is in the operative position.

8. The toner cartridge of claim 1, further comprising:

a channel running along the front of the housing between the first side and the second side in fluid communication with the outlet port, at least a portion of the channel is open to the reservoir; and an auger positioned in the channel and extending along the front of the housing between the first side and the second side, the auger is operative to move toner in the channel toward the outlet port, the auger includes a rotational axis, wherein at least a portion of the electrical contact of the toner cartridge is positioned higher than the rotational axis of the auger when the electrical connector is in the operative position.

9. The toner cartridge of claim 1, further comprising:

a channel running along the front of the housing between the first side and the second side in fluid communication with the outlet port, at least a portion of the channel is open to the reservoir;

an auger positioned in the channel and extending along the front of the housing between the first side and the second side, the auger is operative to move toner in the channel toward the outlet port; and a toner delivery assembly positioned in the reservoir to deliver toner to the channel, the toner delivery assembly includes a drive shaft rotatably mounted in the reservoir, the drive shaft includes a rotational axis, wherein at least a portion of the electrical contact of the toner cartridge is positioned higher than the rotational axis of the drive shaft when the electrical connector is in the operative position.

10. A toner cartridge for use in an electrophotographic image forming device, comprising:

a housing having a top, a bottom, a front and a rear positioned between a first side and a second side of the housing, the housing has a reservoir for holding toner;

an outlet port in fluid communication with the reservoir and facing downward on the front of the housing for exiting toner from the toner cartridge;

an electrical connector on the first side of the housing, the electrical connector is movable between a retracted position and an operative position, the electrical connector includes an electrical contact for contacting a corresponding electrical contact in the image forming device when the electrical connector is in the operative position, the electrical connector and the electrical contact of the toner cartridge move upward toward the top of the housing when the electrical connector moves from the retracted position to the operative position, the electrical connector and the electrical contact of the toner cartridge move downward toward the bottom of the housing when the electrical connector moves from the operative position to the retracted position, the electrical contact of the toner cartridge is electrically connected to processing circuitry mounted on the housing, a linkage operatively connected to the electrical connector, the linkage includes an engagement surface that is accessible on an exterior of the housing to receive an actuation force, wherein movement of the linkage moves the electrical connector between the retracted position and the operative position, wherein when the electrical connector is in the retracted position, the electrical connector is tucked into a portion of the housing.

11. The toner cartridge of claim 10, wherein the electrical connector is biased by a biasing member toward the retracted position.

12. The toner cartridge of claim 10, wherein the electrical connector translates upward toward the top of the housing when the electrical connector moves from the retracted position to the operative position and the electrical connector translates downward toward the bottom of the housing when the electrical connector moves from the operative position to the retracted position.

13. The toner cartridge of claim 10, wherein the linkage is positioned on the first side of the housing and the engagement surface is accessible at the rear of the housing.

14. The toner cartridge of claim 10, wherein the electrical contact of the toner cartridge is positioned within a pocket of the electrical connector, the pocket includes an opening that faces upward when the electrical connector is in the operative position permitting the corresponding electrical contact in the image forming device to enter the pocket from above.

15. The toner cartridge of claim 14, wherein the electrical connector includes a vertical slit on an inner side of the pocket proximate to the reservoir for guiding a post on the corresponding electrical contact in the image forming device as the electrical connector moves upward from the retracted position to the operative position and downward from the operative position to the retracted position.

16. The toner cartridge of claim 10, wherein at least a portion of the electrical contact of the toner cartridge is positioned higher than the outlet port when the electrical connector is in the operative position.

17. The toner cartridge of claim 10, further comprising:

a channel running along the front of the housing between the first side and the second side in fluid communication with the outlet port, at least a portion of the channel is open to the reservoir; and an auger positioned in the channel and extending along the front of the housing between the first side and the second side, the auger is operative to move toner in the channel toward the outlet port, the auger includes a rotational axis, wherein at least a portion of the electrical contact of the toner cartridge is positioned higher than the rotational axis of the auger when the electrical connector is in the operative position.

18. The toner cartridge of claim 10, further comprising:

a channel running along the front of the housing between the first side and the second side in fluid communication with the outlet port, at least a portion of the channel is open to the reservoir;

an auger positioned in the channel and extending along the front of the housing between the first side and the second side, the auger is operative to move toner in the channel toward the outlet port; and a toner delivery assembly positioned in the reservoir to deliver toner to the channel, the toner delivery assembly includes a drive shaft rotatably mounted in the reservoir, the drive shaft includes a rotational axis, wherein at least a portion of the electrical contact of the toner cartridge is positioned higher than the rotational axis of the drive shaft when the electrical connector is in the operative position.

19. A toner cartridge for use in an electrophotographic image forming device, comprising:

a housing having a top, a bottom, a front and a rear positioned between a first side and a second side of the housing, the housing has a reservoir for holding toner;

an outlet port in fluid communication with the reservoir and facing downward on the front of the housing for exiting toner from the toner cartridge;

a channel running along the front of the housing between the first side and the second side in fluid communication with the outlet port, at least a portion of the channel is open to the reservoir;

an auger positioned in the channel and extending along the front of the housing between the first side and the second side, the auger is operative to move toner in the channel toward the outlet port;

a toner delivery assembly positioned in the reservoir to deliver toner to the channel, the toner delivery assembly includes a drive shaft rotatably mounted in the reservoir, the drive shaft includes a rotational axis;

an electrical connector on the first side of the housing, the electrical connector is movable between a retracted position and an operative position, the electrical connector includes an electrical contact for contacting a corresponding electrical contact in the image forming device when the electrical connector is in the operative position, the electrical connector and the electrical contact of the toner cartridge move upward toward the top of the housing when the electrical connector moves from the retracted position to the operative position, the electrical connector and the electrical contact of the toner cartridge move downward toward the bottom of the housing when the electrical connector moves from the operative position to the retracted position, the electrical contact of the toner cartridge is electrically connected to processing circuitry mounted on the housing; and a linkage operatively connected to the electrical connector, the linkage includes an engagement surface that is accessible on an exterior of the housing to receive an actuation force, wherein movement of the linkage moves the electrical connector between the retracted position and the operative position, wherein at least a portion of the electrical contact of the toner cartridge is positioned higher than the rotational axis of the auger and the rotational axis of the drive shaft when the electrical connector is in the operative position.

20. The toner cartridge of claim 19, wherein the electrical connector is biased by a biasing member toward the retracted position.

21. The toner cartridge of claim 19, wherein the electrical connector translates upward toward the top of the housing when the electrical connector moves from the retracted position to the operative position and the electrical connector translates downward toward the bottom of the housing when the electrical connector moves from the operative position to the retracted position.

22. The toner cartridge of claim 19, wherein the linkage is positioned on the first side of the housing and the engagement surface is accessible at the rear of the housing.

23. The toner cartridge of claim 19, wherein the electrical contact of the toner cartridge is positioned within a pocket of the electrical connector, the pocket includes an opening that faces upward when the electrical connector is in the operative position permitting the corresponding electrical contact in the image forming device to enter the pocket from above.

24. The toner cartridge of claim 23, wherein the electrical connector includes a vertical slit on an inner side of the pocket proximate to the reservoir for guiding a post on the corresponding electrical contact in the image forming device as the electrical connector moves upward from the retracted position to the operative position and downward from the operative position to the retracted position.

25. The toner cartridge of claim 19, wherein when the electrical connector is in the retracted position, the electrical connector is tucked into a portion of the housing.

26. A toner cartridge for use in an electrophotographic image forming device, comprising:

a housing having a top, a bottom, a front and a rear positioned between a first side and a second side of the housing, the housing has a reservoir for holding toner;

an outlet port in fluid communication with the reservoir and facing downward on the front of the housing for exiting toner from the toner cartridge;

an electrical connector on the first side of the housing, the electrical connector is movable between a retracted position and an operative position, the electrical connector includes an electrical contact for contacting a corresponding electrical contact in the image forming device when the electrical connector is in the operative position, the electrical connector and the electrical contact of the toner cartridge move upward toward the top of the housing when the electrical connector moves from the retracted position to the operative position, the electrical connector and the electrical contact of the toner cartridge move downward toward the bottom of the housing when the electrical connector moves from the operative position to the retracted position, the electrical contact of the toner cartridge is electrically connected to processing circuitry mounted on the housing; and a linkage operatively connected to the electrical connector, the linkage includes an engagement surface that is accessible on an exterior of the housing to receive an actuation force, wherein movement of the linkage moves the electrical connector between the retracted position and the operative position, wherein when the electrical connector moves from the retracted position to the operative position, the electrical connector and the electrical contact of the toner cartridge protrude through an opening in the housing upward toward the top of the housing.

27. The toner cartridge of claim 26, wherein the electrical connector is biased by a biasing member toward the retracted position.

28. The toner cartridge of claim 26, wherein the electrical connector translates upward toward the top of the housing when the electrical connector moves from the retracted position to the operative position and the electrical connector translates downward toward the bottom of the housing when the electrical connector moves from the operative position to the retracted position.

29. The toner cartridge of claim 26, wherein the linkage is positioned on the first side of the housing and the engagement surface is accessible at the rear of the housing.

30. The toner cartridge of claim 26, wherein the electrical contact of the toner cartridge is positioned within a pocket of the electrical connector, the pocket includes an opening that faces upward when the electrical connector is in the operative position permitting the corresponding electrical contact in the image forming device to enter the pocket from above.

31. The toner cartridge of claim 30, wherein the electrical connector includes a vertical slit on an inner side of the pocket proximate to the reservoir for guiding a post on the corresponding electrical contact in the image forming device as the electrical connector moves upward from the retracted position to the operative position and downward from the operative position to the retracted position.

32. The toner cartridge of claim 26, wherein at least a portion of the electrical contact of the toner cartridge is positioned higher than the outlet port when the electrical connector is in the operative position.

33. The toner cartridge of claim 26, further comprising:

a channel running along the front of the housing between the first side and the second side in fluid communication with the outlet port, at least a portion of the channel is open to the reservoir; and an auger positioned in the channel and extending along the front of the housing between the first side and the second side, the auger is operative to move toner in the channel toward the outlet port, the auger includes a rotational axis, wherein at least a portion of the electrical contact of the toner cartridge is positioned higher than the rotational axis of the auger when the electrical connector is in the operative position.

34. The toner cartridge of claim 26, further comprising:

a channel running along the front of the housing between the first side and the second side in fluid communication with the outlet port, at least a portion of the channel is open to the reservoir;

an auger positioned in the channel and extending along the front of the housing between the first side and the second side, the auger is operative to move toner in the channel toward the outlet port; and a toner delivery assembly positioned in the reservoir to deliver toner to the channel, the toner delivery assembly includes a drive shaft rotatably mounted in the reservoir, the drive shaft includes a rotational axis, wherein at least a portion of the electrical contact of the toner cartridge is positioned higher than the rotational axis of the drive shaft when the electrical connector is in the operative position.

* * * * *